US010745785B2

(12) United States Patent
Li et al.

(10) Patent No.: US 10,745,785 B2
(45) Date of Patent: Aug. 18, 2020

(54) HIGH-PERFORMANCE LOW-ALLOY WEAR-RESISTANT STEEL PLATE AND METHOD OF MANUFACTURING THE SAME

(71) Applicant: BAOSHAN IRON & STEEL CO., LTD., Shanghai (CN)

(72) Inventors: Hongbin Li, Shanghai (CN); Liandeng Yao, Shanghai (CN); Xiaobo Wang, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 100 days.

(21) Appl. No.: 14/761,352

(22) PCT Filed: Mar. 26, 2014

(86) PCT No.: PCT/CN2014/074100
§ 371 (c)(1),
(2) Date: Jul. 16, 2015

(87) PCT Pub. No.: WO2014/154140
PCT Pub. Date: Oct. 2, 2014

(65) Prior Publication Data

US 2016/0032432 A1 Feb. 4, 2016

(30) Foreign Application Priority Data

Mar. 28, 2013 (CN) ..... 2013 1 0105169

(51) Int. Cl.
*C22C 38/54* (2006.01)
*C21D 1/60* (2006.01)
(Continued)

(52) U.S. Cl.
CPC ..... *C22C 38/54* (2013.01); *C21D 1/60* (2013.01); *C21D 6/001* (2013.01); *C21D 6/002* (2013.01);
(Continued)

(58) Field of Classification Search
CPC ..... C22C 38/02; C22C 38/001–54; C22C 38/002; C22C 38/04; C22C 38/06;
(Continued)

(56) References Cited

U.S. PATENT DOCUMENTS

2012/0132322 A1 5/2012 Moody
2013/0095347 A1* 4/2013 Kawasaki ..... B32B 15/013 428/684
(Continued)

FOREIGN PATENT DOCUMENTS

CN 101638755 A 2/2010
CN 102747280 A * 10/2012 ..... C21D 8/0226
(Continued)

OTHER PUBLICATIONS

English language machine translation of JP2012036501 to Yuga et al. Generated Dec. 1, 2017. (Year: 2017).*
(Continued)

*Primary Examiner* — Brian D Walck
(74) *Attorney, Agent, or Firm* — Quarles & Brady LLP

(57) ABSTRACT

A high-performance low-alloy wear-resistant steel sheet and a method of manufacturing the same, which has the chemical compositions (wt %): C: 0.21-0.32%; Si: 0.10-0.50%; Mn: 0.60-1.60%; B: 0.0005-0.0040%; Cr: less than or equal to 1.50%; Mo: less than or equal to 0.80%; Ni: less than or equal to 1.50%; Nb: less than or equal to 0.080%; V: less than or equal to 0.080%; Ti: less than or equal to 0.060%; Al: 0.010-0.080%, Ca: 0.0010-0.0080%, N: less than or equal to 0.0080%, O: less than or equal to 0.0080%, H: less than or equal to 0.0004%, P: less than or equal to 0.015%, S: less than or equal to 0.010%, and (Cr/5+Mn/6+50B): more than or equal to 0.20% and less than or equal to 0.55%; (Mo/3+Ni/5+2Nb): more than or equal to 0.02% and less than or equal to 0.45%; (Al+Ti): more than or equal to 0.01% and
(Continued)

less than or equal to 0.13%, the remainders being Fe and unavoidable impurities. The wear-resistant steel sheet of the present invention obtained by the above-mentioned compositions and TMCP process, has high strength, high hardness, good toughness, excellent wear-resistant performance, and is applicable to wearing parts in various mechanical equipments.

13 Claims, 1 Drawing Sheet

(51) Int. Cl.

| | |
|---|---|
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/00*** | (2006.01) |
| ***C21D 6/00*** | (2006.01) |
| ***C21D 8/02*** | (2006.01) |

(52) U.S. Cl.
CPC ..... *C21D 6/004* (2013.01); *C21D 6/005* (2013.01); *C21D 6/008* (2013.01); *C21D 8/0263* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/22* (2013.01); *C22C 38/24* (2013.01); *C22C 38/26* (2013.01); *C22C 38/28* (2013.01); *C22C 38/32* (2013.01); *C22C 38/44* (2013.01); *C22C 38/46* (2013.01); *C22C 38/48* (2013.01); *C22C 38/50* (2013.01); *C21D 2211/001* (2013.01); *C21D 2211/008* (2013.01)

(58) Field of Classification Search
CPC ..... C22C 38/08; C22C 38/12; C22C 38/14; C22C 38/22; C22C 38/24; C22C 38/26; C22C 38/28; C22C 38/32; C22C 38/44; C22C 38/46; C22C 38/48; C22C 38/50; C22C 38/54; C21D 1/60; C21D 6/001; C21D 6/002; C21D 6/004; C21D 6/005; C21D 6/008; C21D 9/46
USPC ..... 148/320
See application file for complete search history.

(56) References Cited

U.S. PATENT DOCUMENTS

2014/0090755 A1* 4/2014 Ueda ..... C22C 38/02 148/645
2015/0211098 A1* 7/2015 Li ..... C21D 8/0226 148/547

FOREIGN PATENT DOCUMENTS

| | | | | |
|---|---|---|---|---|
| CN | 102876969 | A | 1/2013 | |
| CN | 103205627 | A | 7/2013 | |
| JP | S6431928 | A | 2/1989 | |
| JP | H01172550 | A | 7/1989 | |
| JP | 2000192192 | A | 7/2000 | |
| JP | 2005298909 | * | 10/2005 | |
| JP | 2009030092 | A | 2/2009 | |
| JP | 2009030094 | A | 2/2009 | |
| JP | 2012036501 | A | 2/2012 | |
| KR | 950008691 | B1 | 8/1995 | |
| SU | 759614 | * | 8/1980 | |
| WO | WO-2011158818 | A1 * | 12/2011 | ..... B32B 15/013 |
| WO | WO-2012133910 | A1 * | 10/2012 | ..... C22C 38/02 |

OTHER PUBLICATIONS

PCT International Search Report, PCT/CN2014/074100, dated Jun. 27, 2014, 4 pages.
Notification of Reason for Refusal issued in corresponding Korean Application No. 10-2017-7016488, dated Mar. 14, 2019, 7 pages.

* cited by examiner

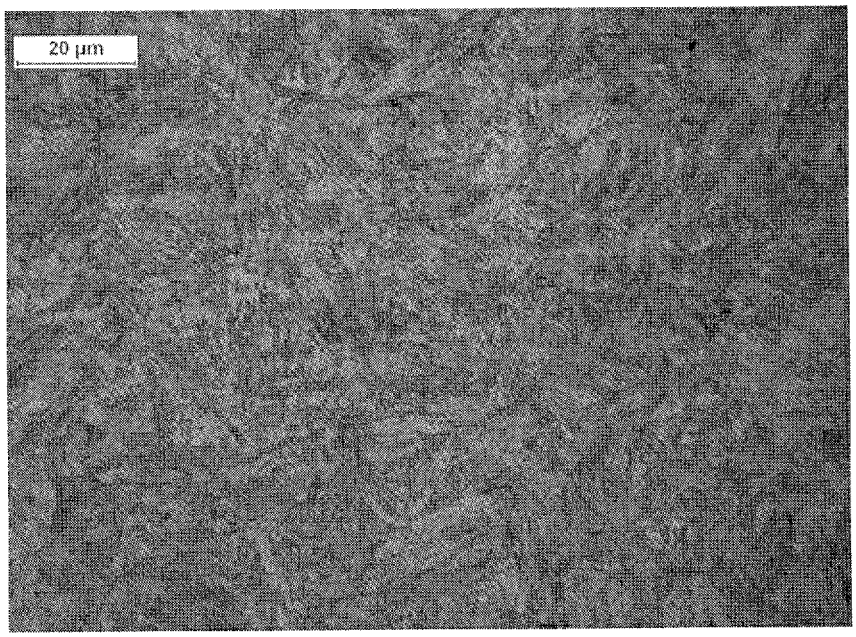
20 μm

HIGH-PERFORMANCE LOW-ALLOY WEAR-RESISTANT STEEL PLATE AND METHOD OF MANUFACTURING THE SAME

CROSS-REFERENCE TO RELATED APPLICATIONS

This application represents the national stage entry of PCT International Application No. PCT/CN2014/074100 filed Mar. 26, 2014, which claims priority of Chinese Patent Application No. 201310105169.9 filed Mar. 28, 2013, the disclosures of which are incorporated by reference here in their entirety for all purposes.

TECHNICAL FIELD

The present invention relates to wear-resistant steel and particularly, to a high-performance low-alloy wear-resistant steel sheet and a method of manufacturing the same, which steel plate has the typical mechanical properties: a tensile strength of more than 1400 Mpa, an elongation rate of more than 11%, Brinell Hardness of more than 450 HB, and −40° C. Charpy V-notch longitudinal impact energy of more than 50 J.

BACKGROUND

Wear-resistant steel sheets are widely applied on mechanical products in the field of projects with very serious operational conditions and requiring high strength and high wear-resistance, mining, agriculture, cement production, harbor, electrical power and metallurgy, such as earth mover, loading machine, excavator, dumper, grab bucket, stack-reclaimer, delivery bending structure, etc.

Traditionally, austenitic high-manganese steel is usually selected to manufacture the wear-resistant parts. Under the effect of large impact load, austenitic high-manganese steel may be strained to induce martensite phase transformation so as to improve the wear resistance thereof. Austenitic high-manganese steel are not suitable for wide application owing to the limitation of high alloy content, bad machining and welding performance, and low original hardness.

In the past decades, rapid development takes place in the exploitation and application of wear-resistant steel. It is usually produced by adding a moderate amount of carbon and alloy elements and through casting, rolling and offline heat treatment, etc. The casting way has the advantages of short work flow, simple process and easy production, but has the disadvantages of excessive alloy content, bad mechanical, welding and machining performances; the rolling way may further reduce the content of the alloy elements, and improve the performance of products thereof, but yet inappropriate for wide application; the heat treatments of offline quenching plus tempering are the main way of producing wear-resistant steel sheet, and the produced wear-resistant steel sheet has low alloy elements, and high performance and can make the industrial production stable. But with the higher requirements on low carbon, energy conservation, and environmental protection, products with low cost, short work flow and high performance, become the inevitable trend in the development of iron and steel industry.

China Patent CN1140205A discloses a wear-resistant steel with medium and high carbon and medium alloy, that is produced by casting, and has high contents of carbon and alloy elements (Cr, Mo, etc.), which results inevitably in bad welding and machining performance.

China Patent CN1865481A discloses a Bainite wear-resistant steel which has high contents of carbon and alloy elements (Si, Mn, Cr, Mo, etc.), thereby being of poor welding performance; and which is produced by air cooling after rolling or by stack cooling, thereby being of low mechanical properties.

SUMMARY

The objective of the present invention is to provide a high-performance low-alloy wear-resistant steel sheet and a method of manufacturing the same, which steel plate has the typical mechanical properties: a tensile strength of more than 1400 Mpa, an elongation rate of more than 11%, Brinell Hardness of more than 450 HB, and −40° C. Charpy V-notch longitudinal impact energy of more than 50 J. It matches the high strength, high hardness and high toughness, and has good machining performance, thereby very beneficial to the wide application on projects.

To achieve the above-mentioned objective, the present invention takes the following technical solution:

A high-performance low-alloy wear-resistant steel sheet, which has the chemical compositions in weight percentage: C: 0.21-0.32%; Si: 0.10-0.50%; Mn: 0.60-1.60%; B: 0.0005-0.0040%; Cr: less than or equal to 1.50%; Mo: less than or equal to 0.80%; Ni: less than or equal to 1.50%; Nb: less than or equal to 0.080%; V: less than or equal to 0.080%; Ti: less than or equal to 0.060%; Al: 0.010-0.080%; Ca: 0.0010-0.0080%; N: less than or equal to 0.0080%; 0: less than or equal to 0.0080%; H: less than or equal to 0.0004%; P: less than or equal to 0.015%; S: less than or equal to 0.010%; and (Cr/5+Mn/6+50B): more than or equal to 0.20% and less than or equal to 0.55%; (Mo/3+Ni/5+2Nb): more than or equal to 0.02% and less than or equal to 0.45%; (Al+Ti): more than or equal to 0.01% and less than or equal to 0.13%, the remainders being Fe and unavoidable impurities; the microstructures thereof being fine martensite and retained austenite, and the volume fraction of the retained austenite being less than or equal to 5%; the typical mechanical properties: a tensile strength of more than 1400 Mpa, an elongation rate of more than 11%, Brinell Hardness of more than 450 HB, and −40° C. Charpy V-notch longitudinal impact energy of more than 50 J.

The respective functionalities of the chemical compositions of the high-performance low-alloy wear-resistant steel sheet according to the present invention are as follows:

Carbon: carbon is the most basic and important element in the wear-resistant steel, that can improve the strength and hardness of the steel, and thus further improve the wear resistance thereof. However it is not good for the toughness and welding performance of the steel. Accordingly, the carbon content in the steel should be controlled between 0.21-0.32 wt %, preferably, between 0.21-0.30 wt %.

Silicon: silicon is subjected to solid solution in ferrite and austenite, to improve their hardness and strength, but excessive silicon may result in sharply decreasing the toughness of the steel. Simultaneously, due to that the affinity between silicon and oxygen is better than that between the silicon and Fe, it is easy to generate silicates with low melting point during welding, and increase the flowability of slag and melted metals, thereby affecting the quality of welding seams. Hence its content should not be too much. The silicon content in the wear-resistant steel of the present invention should be controlled between 0.10-0.50 wt %, preferably, between 0.10-0.40 wt %.

Manganese: manganese improves sharply the hardenability of the steel, and reduces the transformation temperature and critical cooling speed thereof. However, when the content of manganese is too high, it may have a grain coarsening tendency, increasing the susceptibility to tempering embrittleness and prone to causing segregation and cracks of casting blanks, thus lowering the performance of the steel sheet. The manganese content in the wear-resistant steel of the present invention should be controlled between 0.60-1.60 wt %, preferably, between 0.60-1.50 wt %.

Boron: boron can improve the hardenability of steel, but excessive boron may result in hot shortness, and affect the welding performance and hot machining performance. Consequently, it is necessary to control the content of B. The content of B in the wear-resistant steel is controlled between 0.0005-0.0040 wt %, preferably, between 0.0005-0.0020 wt %.

Chromium: chromium can decrease the critical cooling speed and improve the hardenability of the steel. Chromium may form multiple kinds of carbides such as $(Fe,Cr)_3C$, $(Fe,Cr)_7C_3$ and $(Fe,Cr)_{23}C_7$, that can improve the strength and hardness. During tempering, chromium can prevent or retard the precipitation and aggregation of carbide, and improve the temper stability. The chromium content in the wear-resistant steel of the present invention should be controlled less than or equal to 1.50 wt %, preferably, between 0.10-1.20%.

Molybdenum: molybdenum can refine grains and improve the strength and toughness. Molybdenum exists in the sosoloid phase and carbide phase of the steel, hence, the steel containing molybdenum has effects of solid solution and carbide dispersion strengthening. Molybdenum is the element that can reduce the temper brittleness, with improving the temper stability. The molybdenum content in the wear-resistant steel of the present invention should be controlled less than or equal to 0.80 wt %, preferably less than or equal to 0.60% wt %.

Nickel: nickel can reduce the critical cooling speed, and improve the hardenability. Nickel is mutually soluble with ferrum in any ratio, and improves the low-temperature toughness of the steel through refining the ferrite grains, and has the effect of obviously decreasing the cold shortness transformation temperature. For the high level wear-resistant steel with high low-temperature toughness, nickel is a very beneficial additive element. However, excessive nickel may lead to the difficulty of descaling on the surface of the steel sheet and remarkably increase cost, whereby its content should be controlled. The nickel content in the wear-resistant steel of the present invention should be controlled less than or equal to 1.50 wt %, preferably less than or equal to 1.20 wt %.

Niobium: the effects of refining grains and precipitation strengthening of niobium contribute notably to the obdurability of the material, and Nb is the strong former of carbide and nitride which can strongly restrict the growth of austenite grains. Nb improves or enhances the performance of the steel mainly through precipitation strengthening and phase transformation strengthening, and it has been considered as one of the most effective hardening agent in the HSLA steel. The niobium content in the wear-resistant steel of the present invention should be controlled less than or equal to 0.080 wt %, preferably between 0.005-0.080 wt %.

Vanadium: the addition of vanadium is to refine grains, to make the austenite grains free from too coarsening during heating the steel blank. Thus, during the subsequent multi-pass rolling, the steel grains can be further refined and the strength and toughness of the steel is improved. The vanadium content in the wear-resistant steel of the present invention should be controlled less than or equal to 0.080 wt %, preferably less than or equal to 0.060 wt %.

Aluminum: aluminum and nitrogen in the steel may form fine and indissolvable AlN particles, which can refine the grains in the steel. Aluminum can refine the grains in the steel, stabilify nitrogen and oxygen in the steel, alleviate the susceptibility of the steel to the notch, reduce or eliminate the ageing effect and improve the toughness thereof. The content of Al in the wear-resistant steel is controlled between 0.010-0.080 wt %, preferably, between 0.020-0.080 wt %.

Titanium: titanium is one of the formers of strong carbide, and forms fine TiC particles together with carbon. TiC particles are fine, and distributed along the grain boundary, that can reach the effect of refining grains. Harder TiC particles can improve the wear resistance of the steel. The content of titanium in the wear-resistant steel is controlled less than or equal to 0.060 wt %, preferably, between 0.005-0.060 wt %.

Aluminum and titanium: titanium can form fine particles and further refine grains, while aluminum can ensure the formation of fine Ti particles and allow full play of titanium to refine grains. Accordingly, the range of the total content of aluminum plus titanium should be controlled more than or equal to 0.010% and less than or equal to 0.13%, preferably, more than or equal to 0.01% and less than or equal to 0.12%.

Calcium: calcium contributes remarkably to the deterioration of the inclusions in the cast steel, and the addition of an appropriate amount of calcium in the cast steel may transform the strip like sulfide inclusions into spherical CaS or (Ca, Mn) S inclusions. The oxide and sulfide inclusions formed by calcium have low density and tend to float and to be removed. Calcium also reduces the segregation of sulfide at the grain boundary notably. All of those are beneficial to improve the quality of the cast steel, and further improve the performance thereof. The content of calcium in the wear-resistant steel is controlled between 0.0010-0.0080 wt %, preferably, between 0.0010-0.0060 wt %.

Phosphorus and sulphur: both phosphorus and sulphur are harmful elements in the wear-resistant steel, and the content thereof should be controlled strictly. The content of phosphorus in the steel of the present invention is controlled less than or equal to 0.015 wt %, preferably less than or equal to 0.012 wt %; the content of sulphur therein controlled less than or equal to 0.010 wt %, preferably less than or equal to 0.005 wt %.

Nitrogen, oxygen and hydrogen: excessive nitrogen, oxygen and hydrogen in the steel is harmful to the performances such as welding performance, impact toughness and crack resistance, and may reduce the quality and lifetime of the steel sheet. But too strict controlling may substantially increase the production cost. Accordingly, the content of nitrogen in the steel of the present invention is controlled less than or equal to 0.0080 wt %, preferably less than or equal to 0.0050 wt %; the content of oxygen therein controlled less than or equal to 0.0080 wt %, preferably less than or equal to 0.0050 wt %; the content of hydrogen therein controlled less than or equal to 0.0004 wt %, preferably less than or equal to 0.0003 wt %.

The steel related in the present invention matches high strength, high hardness and high toughness on basis of adding micro-alloy elements through scientific design on the element types and contents. The steel has a tensile strength of more than 1400 Mpa, an elongation rate of more than 11%, Brinell Hardness of more than 450 HB, and −40° C. Charpy V-notch longitudinal impact energy of more than 50 J.

In the method of manufacturing the high-performance low-alloy wear-resistant steel sheet, the steel sheet can be obtained through stages of smelting as the aforementioned proportions of the chemical compositions, casting, heating, rolling and cooling directly after rolling; wherein in the heating stage, the slab heating temperature is 1000-1200° C., and the heat preservation time is 1-3 hours; in the stage of rolling, the rough rolling temperature is 900-1150° C., while the finish rolling temperature is 780-880° C.; in the stage of cooling, the steel is water cooled to below 400° C., then air cooled to the ambient temperature, wherein the speed of water cooling is more than or equal to 20° C./s.

Furthermore, the stage of cooling directly after rolling further includes a stage of tempering, in which the heating temperature is 100-400° C., and the heat preservation time is 30-120 min.

Preferably, during the heating process, the heating temperature is 1000-1150° C.; more preferably the heating temperature is 1000-1130° C.; and most preferably, the heating temperature is 1000-1110° C. for improving the production efficiency, and preventing the austenite grains from overgrowth and the surface of the billet from strongly oxidizing.

Preferably, during the stage of rolling, the rough rolling temperature is 900-1100° C., and the reduction rate in the stage of rough rolling is more than 20%, while the finish rolling temperature is 780-860° C., and the reduction rate in the stage of finish rolling is more than 40%; more preferably, the rough rolling temperature is 900-1080° C., and the reduction rate in the stage of rough rolling is more than 25%, while the finish rolling temperature is 780-855° C., and the reduction rate in the stage of finish rolling is more than 45%; most preferably, the rough rolling temperature is 910-1080° C., and the reduction rate in the stage of rough rolling is more than 28%, while the finish rolling temperature is 785-855° C., and the reduction rate in the stage of finish rolling is more than 50%.

Preferably, in the stage of cooling, the cease cooling temperature is below 380° C., the water cooling speed is more than or equal to 23° C./s; more preferably, the cease cooling temperature is below 350° C., the water cooling speed is more than or equal to 27° C./s; most preferably, the cease cooling temperature is below 330° C., and the water cooling speed is more than or equal to 30° C./s.

Preferably, in the stage of tempering, the heating temperature is 100-380° C., and the heat preservation time is 30-100 min; more preferably, the heating temperature is 120-380° C., the heat preservation time is 30-100 min; most preferably, the heating temperature is 150-380° C., the heat preservation time is 30-100 min.

Due to the scientifically designed contents of carbon and alloy elements in the high-performance low-alloy wear-resistant steel sheet of the present invention, and through the refinement strengthening effects of the alloy elements and controlling the rolling and cooling process for structural refinement and strengthening, the obtained wear-resistant steel sheet has high performances such as high hardness, high strength, high elongation rate, and good impact toughness etc., excellent wear resistance, and is easy to be machined such as cut, bended, thereby having high applicability.

The differences between the present invention and the prior art are embodied in the following aspects:

1. regarding the chemical compositions, the wear-resistant steel sheet of the present invention gives priority to medium-low carbon and low alloy, and makes full use of the characteristics of refinement and strengthening of the micro-alloy elements such as Nb, Ti or the like, reducing the contents of carbon and alloy elements such as Cr, Mo, and Ni, and ensuring the good mechanical properties and excellent welding performance of the wear-resistant steel sheet.

2. regarding the production process, the wear-resistant steel sheet of the present invention is produced by TMCP process, and through controlling the process parameters such as start rolling and finish rolling temperatures, rolling deformation amount, and cooling speed in the TMCP process, the structure refinement and strengthening effects are achieved, and further the contents of carbon and alloy elements are reduced, thereby obtaining the steel sheet with excellent mechanical properties and welding performance, etc. Moreover, the process has the characteristics of short work flow, high efficiency, energy conservation and low cost etc.

3. regarding the performance of the products, the wear-resistant steel sheet of the present invention has the advantages such as high strength, high hardness, high low-temperature toughness (typical mechanical properties thereof: a tensile strength of more than 1400 Mpa, an elongation rate of more than 11%, Brinell Hardness of more than 450 HB, and −40° C. Charpy V-notch longitudinal impact energy of more than 50 J), and has good welding performance.

4. regarding the micro-structure, the wear-resistant steel sheet of the present invention makes full use of the addition of the alloy elements and the controlled rolling and controlled cooling processes to obtain fine martensite structures and retained austenite (wherein the volume fraction of the retained austenite is less than or equal to 5%), which are beneficial for matching nicely the strength, hardness and toughness of the wear-resistant steel sheet.

In sum, the wear-resistant steel sheet of the present invention has apparent advantages, and owing to being obtained by controlling the content of carbon and alloy elements and the controlled rolling and controlled cooling, it is of low cost, high strength and hardness, good low-temperature toughness, excellent machining performance, high weldability, and applicable for a variety of vulnerable parts mechanical equipments, whereby this kind of wear-resistant steel sheet is the natural tendency of the development of the social economy and iron-steel industries.

BRIEF DESCRIPTION OF THE DRAWINGS

FIG. 1 is a photograph of the microstructure of the steel sheet in Embodiment 6 according to the present invention.

DETAILED DESCRIPTION

Hereinafter the technical solution of the present invention will be further set out in conjunction with the detailed embodiments. It should be specified that those embodiments are only used for describing the detailed implements of the present invention, but not for constituting any limitation on the protection scope thereof.

Table 1 shows the chemical compositions in weight percentage of the wear-resistant steel sheet in Embodiments 1-10 and the steel sheet in the contrastive example 1 (which is an embodiment in the patent CN1865481A). The method of manufacturing them is: the respective smelt raw materials are treated in the following stages: smelting—casting - - - heating - - - rolling - - - cooling directly after rolling - - - tempering (not necessary), and the chemical elements in weight percentage are controlled, wherein, in the stage of heating, the slab heating temperature is 1000-1200° C., and the hear preservation time is 1-3 hours; in the stage of rolling, the rough rolling temperature is 900-1150° C., while the finish rolling temperature is 780-880° C.; in the stage of cooling, the steel is water cooled to below 400° C., then air cooled to the ambient temperature, wherein the speed of water cooling is more than or equal to 20° C./s; in the stage of tempering, the heating temperature is 100-400° C., and the heat preservation time is 30-120 min. The specific process parameters in Embodiments 1-10 are shown in Table 2.

TABLE 1

Chemical Compositions in Embodiments 1-10 and in Contrastive Example 1 (unit: wt %)

| | C | Si | Mn | P | S | Cr | Mo | Ni | Nb | V | Ti | Al | B | Ca | N | O | H |
|---|---|---|---|---|---|---|---|---|---|---|---|---|---|---|---|---|---|
| Embodiment 1 | 0.21 | 0.50 | 1.25 | 0.010 | 0.005 | 0.60 | 0.33 | / | 0.016 | / | 0.019 | 0.027 | 0.0012 | 0.0030 | 0.0042 | 0.0060 | 0.0004 |
| Embodiment 2 | 0.23 | 0.26 | 1.50 | 0.009 | 0.010 | / | 0.28 | 0.35 | 0.020 | 0.080 | 0.005 | 0.035 | 0.0005 | 0.0020 | 0.0080 | 0.0040 | 0.0002 |
| Embodiment 3 | 0.24 | 0.40 | 1.33 | 0.015 | 0.004 | 0.22 | / | / | 0.026 | / | / | 0.010 | 0.0013 | 0.0080 | 0.0050 | 0.0028 | 0.0002 |
| Embodiment 4 | 0.25 | 0.37 | 1.23 | 0.008 | 0.003 | 0.62 | 0.26 | / | / | / | 0.022 | 0.020 | 0.0015 | 0.0060 | 0.0028 | 0.0021 | 0.0003 |
| Embodiment 5 | 0.27 | 0.31 | 1.15 | 0.008 | 0.003 | 0.28 | / | 0.40 | 0.021 | / | 0.040 | 0.080 | 0.0019 | 0.0010 | 0.0038 | 0.0030 | 0.0003 |
| Embodiment 6 | 0.28 | 0.19 | 1.05 | 0.010 | 0.004 | 0.38 | 0.45 | / | 0.035 | / | 0.010 | 0.052 | 0.0020 | 0.0030 | 0.0029 | 0.0028 | 0.0002 |
| Embodiment 7 | 0.29 | 0.28 | 0.88 | 0.009 | 0.003 | / | / | / | 0.018 | / | 0.032 | 0.060 | 0.0017 | 0.0020 | 0.0035 | 0.0022 | 0.0002 |
| Embodiment 8 | 0.30 | 0.22 | 0.93 | 0.008 | 0.002 | 0.72 | 0.60 | / | 0.040 | / | 0.050 | 0.041 | 0.0015 | 0.0040 | 0.0032 | 0.0018 | 0.0002 |
| Embodiment 9 | 0.31 | 0.28 | 0.78 | 0.009 | 0.003 | 1.00 | 0.80 | / | 0.028 | / | 0.023 | 0.032 | 0.0018 | 0.0020 | 0.0053 | 0.0038 | 0.0003 |
| Embodiment 10 | 0.32 | 0.10 | 0.60 | 0.009 | 0.002 | 0.77 | 0.16 | 1.00 | 0.039 | 0.055 | 0.017 | 0.056 | 0.0017 | 0.0030 | 0.0037 | 0.0026 | 0.0002 |
| Contrastive Example 1 | 0.40 | 1.12 | 2.26 | <0.04 | <0.03 | 1.0 | 0.8 | — | — | — | — | — | — | — | — | — | — |

TABLE 2

Specific Process Parameters in Embodiments 1-10

| | Slab Heating Temp. ° C. | Heat Prev. Time h | Rough Rolling Temp. ° C. | Rough Rolling Deform. Rate % | Finish Rolling Temp. ° C. | Finish Rolling Deform. Rate % | Cooling Way | Cooling Speed ° C./s | Cease Cooling Temp. ° C. | Temper. Temp. ° C. | Heat Prev. Time min | Thickness of Steel Sheet mm |
|---|---|---|---|---|---|---|---|---|---|---|---|---|
| Embodiment 1 | 1000 | 2 | 950 | 25 | 795 | 51 | water | 25 | 300 | / | / | 25 |
| Embodiment 2 | 1120 | 2 | 1050 | 30 | 830 | 62 | water | 33 | 250 | / | / | 37 |
| Embodiment 3 | 1050 | 2 | 995 | 20 | 806 | 46 | water | 20 | 400 | / | / | 35 |
| Embodiment 4 | 1080 | 2 | 1010 | 33 | 780 | 40 | water | 40 | 170 | / | / | 20 |
| Embodiment 5 | 1100 | 2.5 | 1060 | 28 | 815 | 55 | water | 33 | 265 | / | / | 39 |
| Embodiment 6 | 1110 | 2.5 | 1080 | 41 | 880 | 66 | water | 36 | 205 | / | / | 28 |
| Embodiment 7 | 1130 | 2.5 | 1110 | 37 | 856 | 70 | water | 42 | Ambient Temp. | / | / | 35 |
| Embodiment 8 | 1140 | 3 | 1120 | 29 | 832 | 61 | water | 50 | 85 | / | / | 15 |
| Embodiment 9 | 1150 | 3 | 1130 | 35 | 841 | 59 | water | 66 | 106 | 335 | 60 | 20 |
| Embodiment 10 | 1200 | 3 | 1150 | 26 | 815 | 69 | water | 37 | 150 | / | / | 31 |

1. Mechanical Property Test

The high-performance low-alloy wear-resistant steel sheets in Embodiments 1-10 are tested for mechanical properties, and the results thereof are shown in Table 3.

TABLE 3

| | | Transverse Stretch | | Charpy V-notch |
|---|---|---|---|---|
| | Hardness HBW | Tensile Strength MPa | Elongation rate % | Longitudinal Impact Energy (−40° C.), J |
| Embodiment 1 | 478 | 1480 | 14% | 85 |
| Embodiment 2 | 489 | 1515 | 14% | 81 |
| Embodiment 3 | 505 | 1555 | 14% | 78 |
| Embodiment 4 | 519 | 1580 | 14% | 75 |
| Embodiment 5 | 525 | 1610 | 14% | 71 |
| Embodiment 6 | 531 | 1640 | 14% | 69 |
| Embodiment 7 | 538 | 1660 | 13% | 68 |
| Embodiment 8 | 542 | 1695 | 13% | 65 |

TABLE 3-continued

| | | Transverse Stretch | | Charpy V-notch |
|---|---|---|---|---|
| | Hardness HBW | Tensile Strength MPa | Elongation rate % | Longitudinal Impact Energy (−40° C.), J |
| Embodiment 9 | 553 | 1730 | 13% | 60 |
| Embodiment 10 | 559 | 1750 | 13% | 53 |
| Contrastive Example 1 | About 400 (HRC43) | 1250 | 10 | — |

Seen from Table 3, the wear-resistant steel sheet in Embodiments 1-10 has a tensile strength of 1450-1800 Mpa, an elongation rate of 13-14%, Brinell Hardness of 470-560HBW, and −40° C. Charpy V-notch longitudinal impact energy of 50-90 J, which indicates that the wear-resistant steel sheet of the present invention has not only high strength, high hardness, good elongation rate etc. but also excellent low-temperature impact toughness. The strength, hardness, and elongation rate of the steel sheet of the present invention are obviously superior to that in contrastive example 1.

2. Wear Resistance Test

The wear resistance test is performed on ML-100 abrasive wear testing machine. When cutting out a sample, the axis of the sample is perpendicular to the steel sheet surface, and the wear surface of the sample is the rolled surface of the steel sheet. The sample is machined into a step-like cylinder body with a tested part of Φ4 mm and a clamped part of Φ5 mm. Before testing, the sample is rinsed by alcohol, and dried by a blower, then weighted on a scale with a precision of ten thousandth. The measured weight is taken as the original weight, then it is mounted onto an elastic clamp. The test is performed by an abrasive paper with 80 grits, under an effect of a load 84N. After the test, due to the wear between the sample and the abrasive paper, a spiral line may be drawn on the abrasive paper by the sample. According to the start radius and end radius of the spiral line, the length of the spiral line is calculated out with the following formula:

$$S = \frac{\pi(r_1^2 - r_2^2)}{a}$$

wherein, r1 is the start radius of the spiral line; r2 is the end radius of the spiral line; a is the feed of the spiral line. In each test, weighting is performed for three times, and the average results are used. Then the weight loss is calculated, and the weight loss per meter indicates the wear rate of the sample (mg/M).

The wear resistance test is performed on the super-strength high-toughness low-alloy wear-resistant steel sheet in Embodiments 1-10 of the present invention. The wearing test results of the steel in these embodiments according to the present invention and the contrastive example 2 (in which a steel sheet with a hardness of 450 HB is used) are shown in Table 4.

TABLE 4

Wearing Test Results of the Steel in Embodiments 1-10 and The Contrastive Example 2

| Steel Type | Test Temp. | Wearing Test Conditions | Wearing Rate (mg/M) |
|---|---|---|---|
| Embodiment 1 | Ambient Temp. | 80-grit abrasive paper/ 84 N load | 13.033 |
| Embodiment 2 | Ambient Temp. | 80-grit abrasive paper/ 84 N load | 12.801 |
| Embodiment 3 | Ambient Temp. | 80-grit abrasive paper/ 84 N load | 12.567 |
| Embodiment 4 | Ambient Temp. | 80-grit abrasive paper/ 84 N load | 12.316 |
| Embodiment 5 | Ambient Temp. | 80-grit abrasive paper/ 84 N load | 12.225 |
| Embodiment 6 | Ambient Temp. | 80-grit abrasive paper/ 84 N load | 12.138 |
| Embodiment 7 | Ambient Temp. | 80-grit abrasive paper/ 84 N load | 12.058 |
| Embodiment 8 | Ambient Temp. | 80-grit abrasive paper/ 84 N load | 11.925 |
| Embodiment 9 | Ambient Temp. | 80-grit abrasive paper/ 84 N load | 11.845 |
| Embodiment 10 | Ambient Temp. | 80-grit abrasive paper/ 84 N load | 11.736 |

TABLE 4-continued

Wearing Test Results of the Steel in Embodiments 1-10 and The Contrastive Example 2

| Steel Type | Test Temp. | Wearing Test Conditions | Wearing Rate (mg/M) |
|---|---|---|---|
| Contrastive example 2 | Ambient Temp. | 80-grit abrasive paper/ 84 N load | 11.668 |

It is known from Table 4 that in this wearing condition, the wearing performance of the high-performance low-alloy wear-resistance according to the present invention is better than that of the contrastive example 2.

3. Welding Performance Test

According to the Y-slit weld cracking test (GB4675.1-84), a Y-slit weld cracking test is performed, and five groups are tested.

First, the constrained welding seams are welded through the rich Ar gas shielding weld, by using JM-58 welding wires of Φ1.2. During the welding process, the angular deformation of the test piece is strictly controlled. After welding, they are cooled to the ambient temperature, so as to weld the tested seams. The seams are welded under the ambient temperature and 48 hours after completing the welding, the cracks on the surfaces, sections and root of the seams are detected. This detection is carried out by dissection test and staining. The welding conditions are 170 A×25V×160 mm/min.

The welding performance test is performed on the wear-resistant steel sheet of Embodiments 1-10 according to the present invention, and the test results are shown as Table 5.

TABLE 5

The Results of Welding Performance Test of Embodiments 1-10

| | Pre-heat Temp. | Sample No. | Surface Crack Ratio, % | Root Crack Ratio, % | Section Crack Ratio, % | Ambient. Temp. | Relative Humidity |
|---|---|---|---|---|---|---|---|
| Embodiment 1 | 85° C. | 1 | 0 | 0 | 0 | 25° C. | 66% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Embodiment 2 | 93° C. | 1 | 0 | 0 | 0 | 32° C. | 59% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Embodiment 3 | 105° C. | 1 | 0 | 0 | 0 | 26° C. | 62% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Embodiment 4 | 118° C. | 1 | 0 | 0 | 0 | 29° C. | 61% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Embodiment 5 | 138° C. | 1 | 0 | 0 | 0 | 33° C. | 66% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Embodiment 6 | 158° C. | 1 | 0 | 0 | 0 | 29° C. | 63% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |

TABLE 5-continued

The Results of Welding Performance Test of Embodiments 1-10

| | Preheat Temp. | Sample No. | Surface Crack Ratio, % | Root Crack Ratio, % | Section Crack Ratio, % | Ambient. Temp. | Relative Humidity |
|---|---|---|---|---|---|---|---|
| Embodiment 7 | 169° C. | 1 | 0 | 0 | 0 | 33° C. | 65% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Embodiment 8 | 171° C. | 1 | 0 | 0 | 0 | 27° C. | 58% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Embodiment 9 | 188° C. | 1 | 0 | 0 | 0 | 27° C. | 61% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Embodiment 10 | 200° C. | 1 | 0 | 0 | 0 | 30° C. | 60% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |

It is known from Table 5 that the wear-resistant steel sheets of Embodiments 1-10 according to the present invention presents no cracks on the surfaces after welding under a certain preheating condition, which indicates that the wear-resistant steel sheet of the present invention has good welding performance.

4. Microstructure

The microstructures are obtained by checking the wear-resistant steel sheet of Embodiment 5. As shown in FIG. 1, the microstructures are fine martensite and a trace of retained austenite, wherein the volume fraction of the retained austenite is less than or equal to 5%, which ensures that the steel sheet has excellent mechanical properties.

The present invention, under the reasonable conditions of production process, designs scientifically the compositions of carbon and alloy elements, and the ratios thereof, reducing the cost of alloys; and makes full use of TMCP processes to refine and strengthen the structures, such that the obtained wear-resistant steel sheet has high performance, such as high hardness, high strength, high elongation rate and good impact toughness etc., has excellent welding performance and wear resistance, and easy to be machined such as cut, bended, thereby having high applicability.

We claim:

1. A hot-rolled steel sheet, comprising:

a) more than 0.27 to 0.32 wt % carbon (C);
b) 0.10-0.50 wt % silicon (Si);
c) 0.6-0.88 wt % manganese (Mn);
d) 0.0005-0.0040 wt % boron (B);
e) less than or equal to 1.50 wt % chromium (Cr);
f) 0.16-0.80 wt % molybdenum (Mo);
g) less than or equal to 1.50 wt % nickel (Ni);
h) less than or equal to 0.080 wt % niobium (Nb);
i) 0% vanadium (V) or 0.055 wt % to 0.080 wt % vanadium (V);
j) less than or equal to 0.060 wt % titanium;
k) 0.010-0.080 wt % aluminum (Al);
l) 0.0010-0.0080 wt % calcium (Ca);
m) less than or equal to 0.0080 wt % nitrogen (N);
n) less than or equal to 0.0080 wt % oxygen (O);
o) less than or equal to 0.0004 wt % hydrogen (H);
p) less than or equal to 0.015 wt % phosphorus (P);
q) less than or equal to 0.010 wt % sulfur;
r) 0.20-0.55 wt % (Cr/5+Mn/6+50B);
s) 0.02-0.45 wt % (Mo/3+Ni/5+2Nb);
t) 0.01-0.13 wt % (Al+Ti); and
u) a balance of iron (Fe) and other impurities;

wherein the steel sheet comprises microstructures of martensite and retained austenite, and the retained austenite comprises less than or equal to 5% (v/v) of the steel;

wherein the steel sheet exhibits a tensile strength of equal to or more than 1450 MPa, an elongation rate of more than 11%, a Brinell Hardness of equal to or more than 470 HB, and a Charpy V-notch longitudinal impact energy of more than 50 J when measured at −40° C.; and wherein the thickness of the hot-rolled steel sheet is in a range from 15 mm to 39 mm.

2. The steel sheet according to claim 1, comprising 0.10-0.40 wt % silicon.

3. The steel sheet according to claim 1, comprising 0.60-0.88 wt % manganese; 0.0005-0.0020 wt % boron; 0.10-1.20 wt % chromium; and 0.20-0.50 wt % (Cr/5+Mn/6+50B).

4. The steel sheet according to claim 1, comprising 0.16-0.60 wt % molybdenum; less than or equal to 1.20 wt % nickel; 0.005-0.080 wt % niobium; and 0.04-0.40 wt % (Mo/3+Ni/5+2Nb).

5. The steel sheet according to claim 1, comprising 0.0010-0.0060 wt % calcium.

6. The steel sheet according to claim 1, comprising less than or equal to 0.0050 wt % nitrogen; less than or equal to 0.0050 wt % oxygen; less than or equal to 0.0003 wt % hydrogen; less than or equal to 0.012 wt % phosphorus; and less than or equal to 0.005 wt % sulfur.

7. The steel sheet according to claim 1, comprising 0.005-0.060 wt % titanium; 0.020-0.080 wt % aluminum; and 0.01-0.12 wt % (Al+Ti).

8. A method of manufacturing the hot-rolled steel sheet of claim 1, the method comprising:

a) smelting the elements of claim 1 to produce a smelted material;
b) casting the smelted material to produce a casted material,
c) heating the casted material to a slab heating temperature ranging from 1000-1200 for a heat preservation time ranging from 1-3 hours;
d) rolling the heated material to a rough rolling temperature ranging from 900-1150° C. and a finish rolling temperature ranging from 780-880° C.; and
e) water cooling the rolled material to below 400° C. at a cooling speed greater than or equal to 20° C./s; and
f) air cooling the water cooled material to ambient temperature, wherein the hot-rolled steel sheet is produced.

9. The method of claim 8, further comprising tempering the cooled material at a heating temperature ranging from 100-400° C., for a heat preservation time of 30-120 min.

10. The method of claim 8, wherein the slab heating temperature ranges from 1000-1150° C.

11. The method of claim 8, wherein the rough rolling temperature ranges from 900-1100° C., and the rough rolling reduction rate is more than 20%, and the finish rolling temperature ranges from 780-860° C., and the finish rolling reduction rate is more than 40%.

12. The method of claim 8, wherein the rolled material is water cooled to a temperature below 380° C. at a cooling speed greater than or equal to 23° C./s.

13. The method of claim 9, wherein the tempering temperature ranges from 100-380° C., and the heat preservation time ranges from 30-100 min.

* * * * *